US011560252B2

(12) United States Patent
Zeiler

(10) Patent No.: US 11,560,252 B2
(45) Date of Patent: Jan. 24, 2023

(54) FOLDING CARTON

(71) Applicant: Huhtamaki, Inc., De Soto, KS (US)

(72) Inventor: George Zeiler, Olathe, KS (US)

(73) Assignee: HUHTAMAKI, INC., De Soto, KS (US)

( * ) Notice: Subject to any disclaimer, the term of this patent is extended or adjusted under 35 U.S.C. 154(b) by 316 days.

(21) Appl. No.: 16/853,595

(22) Filed: Apr. 20, 2020

(65) Prior Publication Data

US 2020/0339303 A1 Oct. 29, 2020

Related U.S. Application Data

(60) Provisional application No. 62/838,459, filed on Apr. 25, 2019.

(51) Int. Cl.

| | |
|---|---|
| ***B65D 5/20*** | (2006.01) |
| ***B65D 5/36*** | (2006.01) |
| ***B65D 5/42*** | (2006.01) |
| ***B31B 50/26*** | (2017.01) |
| *B31B 50/73* | (2017.01) |
| *B31B 120/30* | (2017.01) |

(52) U.S. Cl.

CPC ..... *B65D 5/2057* (2013.01); *B31B 50/26* (2017.08); *B65D 5/3642* (2013.01); *B65D 5/4266* (2013.01); *B31B 50/734* (2017.08); *B31B 2120/30* (2017.08)

(58) Field of Classification Search

CPC .. B65D 5/2057; B65D 5/3642; B65D 5/4266; B65D 5/667; B65D 5/6667; B65D 5/241; B65D 5/3657; B65D 5/0085; B65D 5/061; B65D 5/6664; B65D 5/24; B31B 50/26; B31B 2120/302

USPC ..... 229/117.07, 145, 190, 186, 171, 147, 229/125.27; 493/137, 139, 140

See application file for complete search history.

(56) References Cited

U.S. PATENT DOCUMENTS 2,957,617 A * 10/1960 Bolding ..... B65D 5/3642 229/149

4,791,883 A * 12/1988 Lehman ..... B65D 5/0005 229/101

(Continued)

OTHER PUBLICATIONS

Six Corners Beers Tray (aka Biers), CartonCraft Incorporated, http://cartoncraftinc.com/product/six-comer-beers-tray-aka-biers/, 4 pages. Accessed Jul. 6, 2020.

(Continued)

*Primary Examiner* — Christopher R Demeree

(74) *Attorney, Agent, or Firm* — Husch Blackwell LLP

(57) ABSTRACT

A foldable carton is provided. The carton includes a bottom panel, a front panel, a rear panel, end panels, each foldably connected to the edges of the bottom panel. The carton further includes front end flap panels connected to the lateral ends of the front panel and rear end flap panels connected to the lateral ends of the rear panel. Each front end flap panel includes a connecting end section and a triangular fold flap connected to the connected end section. The triangular fold flap is connected to a side edge of the adjacent end panel by a hinged fold line. The connecting end section is secured to the front panel in an overlying arrangement and the triangular fold flap is configured to about the hinged fold line to allow the front panel to freely move between a fully upright position and a partially upright position.

20 Claims, 9 Drawing Sheets

(56) References Cited

U.S. PATENT DOCUMENTS 4,890,576 A * 1/1990 James ..... B65D 5/0005
119/168
5,249,550 A * 10/1993 Hines ..... B65D 5/0005
229/101

OTHER PUBLICATIONS

Six Corner (Point) Beers (a.k.a.) Biers, The New York Label & Box Works, /www.since1878.com/carton-styles-details.php?styleID=2104, 3 pages. Accessed Jul. 6, 2020.

* cited by examiner

FOLDING CARTON

CROSS-REFERENCE TO RELATED APPLICATIONS

This Application claims priority to U.S. Provisional Patent Application Ser. No. 62/838,459, filed on Apr. 25, 2019, to George Zeiler, entitled "Folding Carton," the entire disclosure of which is incorporated herein by reference.

BACKGROUND OF THE INVENTION

Foldable cartons, trays and containers are commonly used in the quick-service food industries as well as various other industries as vessels for holding, transporting and storing food and other items. One common form of these cartons includes the conventional glued six-corner Biers box. Such cartons are commonly constructed from a flat blank, formed into a folded shape or position, and then unfolded and erected into a carton having a perimeter sidewall. They are popular due to their efficient use of raw material, they are easy to unfold and use, and they can be stored and shipped flat. However, the design of these foldable cartons is limited in their dimensional configuration, which causes them to be undesirable and unusable in certain applications. The reason for this dimensional limitation is due to the fact the both the front and rear sidewalls are folded inward when the carton is formed and placed into its folded shape. As a result, such cartons cannot have front and rear sidewalls with a height that exceeds one-half the depth of the bottom panel because the front and rear panels would obstruct and interfere with one another when folding inward into the folded position of the carton. This prevents elongated, narrow carton designs often desirable for quick-service and other applications.

Another problem with existing foldable carton designs is that the locking mechanisms often fail to adequately secure the cover portion to the base portion of the carton. This is often due to the difficulty in creating sufficient engagement between the connecting portions of the carton.

Accordingly, a need exists for a foldable carton that can be formed from a unitary blank and formed without dimensional restrictions with respect to the sidewall heights and bottom panel depth. Additionally, a need exists for such a foldable carton that can be configured from a folded state and maintain sufficient form and rigidity after formation and be adequately secured in a closed position.

BRIEF SUMMARY OF THE INVENTION

The present invention is directed generally to a foldable carton configured for being folded into a compact, flattened configuration and unfolded into a box-like structure when ready for use. The present invention is further directed to a unitary blank used for forming the foldable carton. The foldable carton can include a bottom panel, a front panel foldably connected to the bottom panel, a rear panel foldably connected to the bottom panel opposing the front panel, end panels foldably connected to the bottom panel along edges adjacent the front and rear panels, a front end flap panel provided along each lateral end of the front panel and foldably connected to both the front panel and the adjacent end panel, and a rear end flap panel provided along each lateral end of the rear panel and foldably connected to the rear panel.

In the formed carton, each front end flap panel can include a connecting end section that is secured to the interior surface of the front panel in an overlapped arrangement and a triangular fold flap extending from the connecting end section. Each front end flap panel can include an intermediate fold line that bifurcates the front end flap panel into the connecting end section and the triangular fold flap. The triangular fold flap can be formed or defined by the intermediate fold line extending diagonally through the interior of the front end flap panel so that the triangular end flap is foldable with respect to the connecting end section and the front panel. The triangular fold flap can further be foldably connected to an adjacent side edge of the corresponding end panel by a hinged fold line so that the triangular fold flap also foldable with respect to that end panel. In other words, the triangular fold flap can be foldable with respect to the end panel, the connecting end section, and the front panel. Put differently, the end panel, the connecting end section, and the front panel may all be foldable relative to the adjacent triangular fold flap.

Each end panel can also include a triangular fold flap formed along the longitudinal edge of the end panel opposite the front end flap panel. The triangular fold flap can be formed by an intermediate fold line extending diagonally through the interior of the end panel. The triangular fold flap can be secured to an interior or exterior side of a rear end flap panel that, in turn, is foldably connected to the rear panel. Alternatively, triangular fold flap can be secured to an interior or exterior side of the rear panel in an overlapped arrangement so that the end panel is foldable with respect to the rear panel.

The front panel of the foldable carton can be configured to hinge or fold about the longitudinal front edge connecting the front panel to the bottom panel so that the front panel can rotate between a fully upright position and a partially upright position. The front panel can be free to extend away from the bottom panel to the partially upright position due to the triangular fold flap of the front end flap panel that is configured to rotate at each end by the intermediate fold line and the hinged connection. To that end, the front panel can rotate outwardly to the front of the carton, away from the remainder of the carton, including the end panels, rear panel, and cover portion.

The foldable carton can include a cover portion foldably connected to the upper edge of the rear panel. The cover portion can include a cover panel foldably connected to the rear panel along the upper edge of the rear panel and a front cover panel foldably connected to the cover panel along its longitudinal edge opposite the rear panel.

The foldable carton can also include a locking mechanism configured to secure the cover portion in a closed position with respect to the remainder of the carton. The locking mechanism can include a locking tab defined into an upper edge of the front panel and a slot defined into the front cover panel so that that locking tab can frictionally engage the slot when the cover is in the closed position. Other suitable locking mechanisms are also within the scope of the present invention.

The foldable carton can be configured to transition between a folded configuration and an unfolded configuration. In the folded configuration, the front end flap panels, the end panels and the rear panels can be folded inward and the front panel can be extended away from the bottom panel (and the remainder of the carton, including the end panels, rear panel, and cover portion) to position the front panel and the bottom panel in a generally flattened and parallel arrangement. The rear panel can further be folded inward relative to the bottom panel so that the rear panel is generally parallel to and overlies the bottom panel. The cover portion can also be folded into an overlapping arrangement with the front panel and the bottom panel to place the foldable carton into a flattened, folded configuration.

The arrangement and configuration of the front end flap panels, end panels and rear panel can enable the foldable carton to be configured with any suitable dimensions while still enabling the carton to be folded into a generally flattened, folded configuration. According to certain embodiments, the foldable carton can be constructed as a narrow and/or elongated carton where the height of the front and rear panels is greater than one-half the depth of the bottom panel.

Other aspects and advantages of the present invention will be apparent from the following detailed description of the preferred embodiments of the accompanying drawing figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
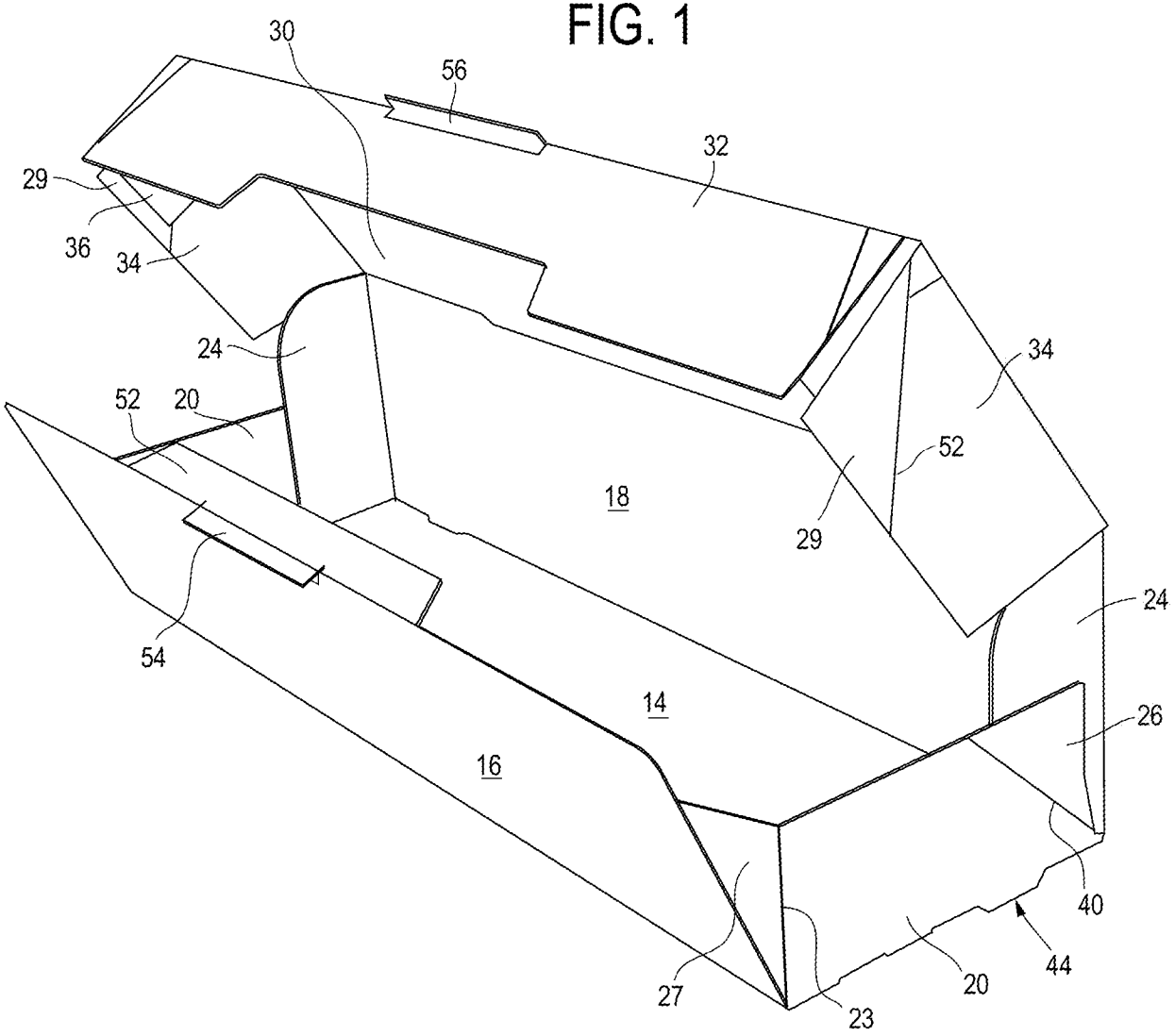
FIG. 1 is a perspective view of a foldable carton in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally toward a foldable carton or tray 10 as shown in FIG. 1 that is configured for being folded into a compact, flattened configuration regardless of the sidewall dimensions of the carton 10, and then easily unfolded into box-like structure configured for holding contents within the interior of the carton 10. As described in greater detail herein, carton 10 of the present invention can be particularly suitable when it is desirable to have a narrow and/or elongated carton with a dimensional configuration where the height of the carton sidewalls is greater than one-half the depth of the carton bottom, for example. Carton 10 of the present invention allows for such a dimensional configuration while still being configured to fold into a generally flattened and folded configuration when not in use, for example during storage or transportation.

Figure 2:
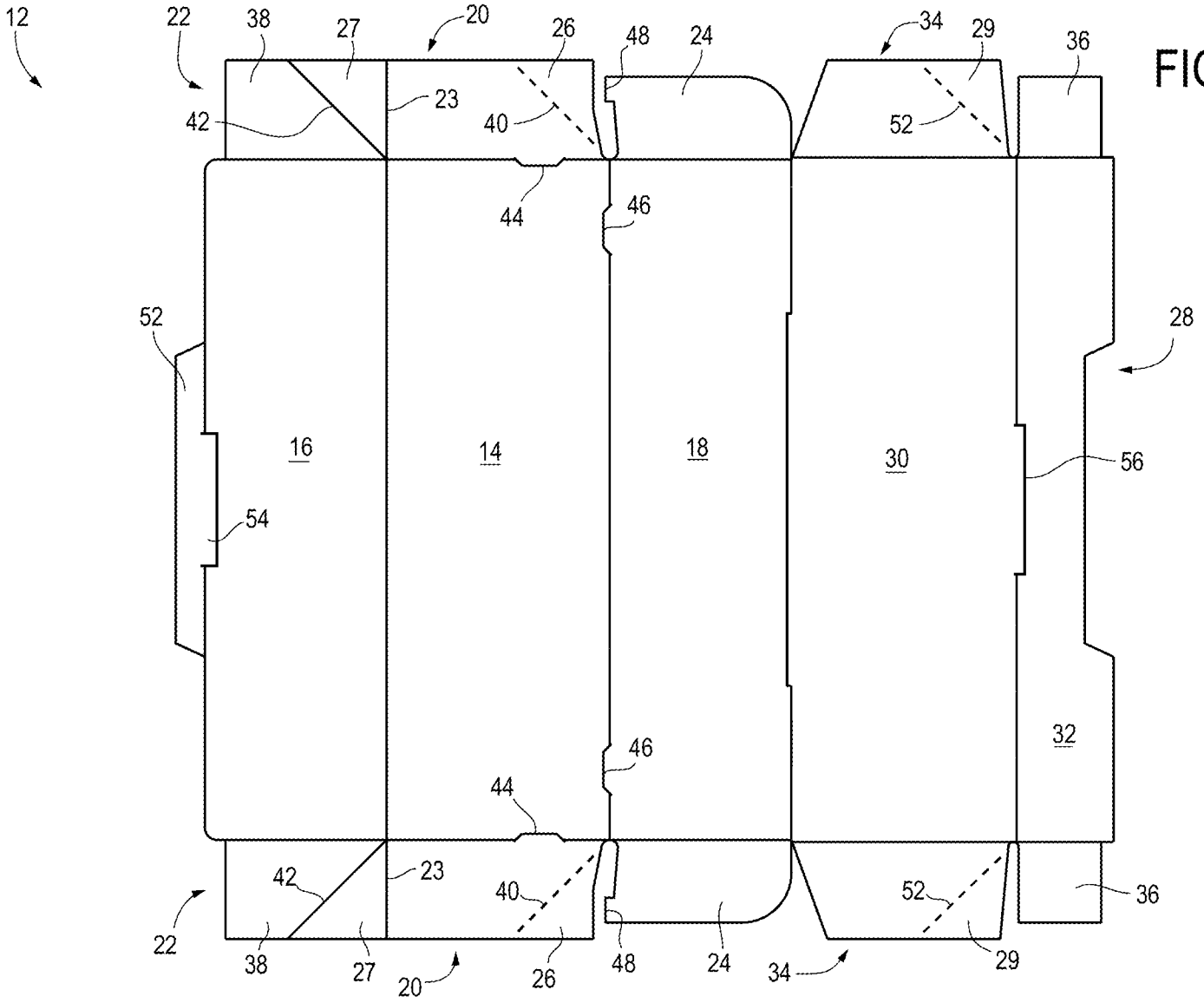
FIG. 2 is a plan view of a blank for a foldable carton in accordance with one embodiment of the present invention.

As best shown in FIG. 2, carton 10 can be constructed from a unitary blank 12 that is formed from a coated or uncoated paperboard, cardboard material, Kraft paper, or other suitable material. In addition, carton 10 can be constructed using more than one material and/or incorporating viewing windows or slots depending on the desired application of carton 10. Depending on the desired application and use, carton 10 can be constructed in any suitable shape or design, such as a conventional four-corner carton, a six-corner carton, a clamshell carton, or any other suitable design or configuration.

Figure 3:
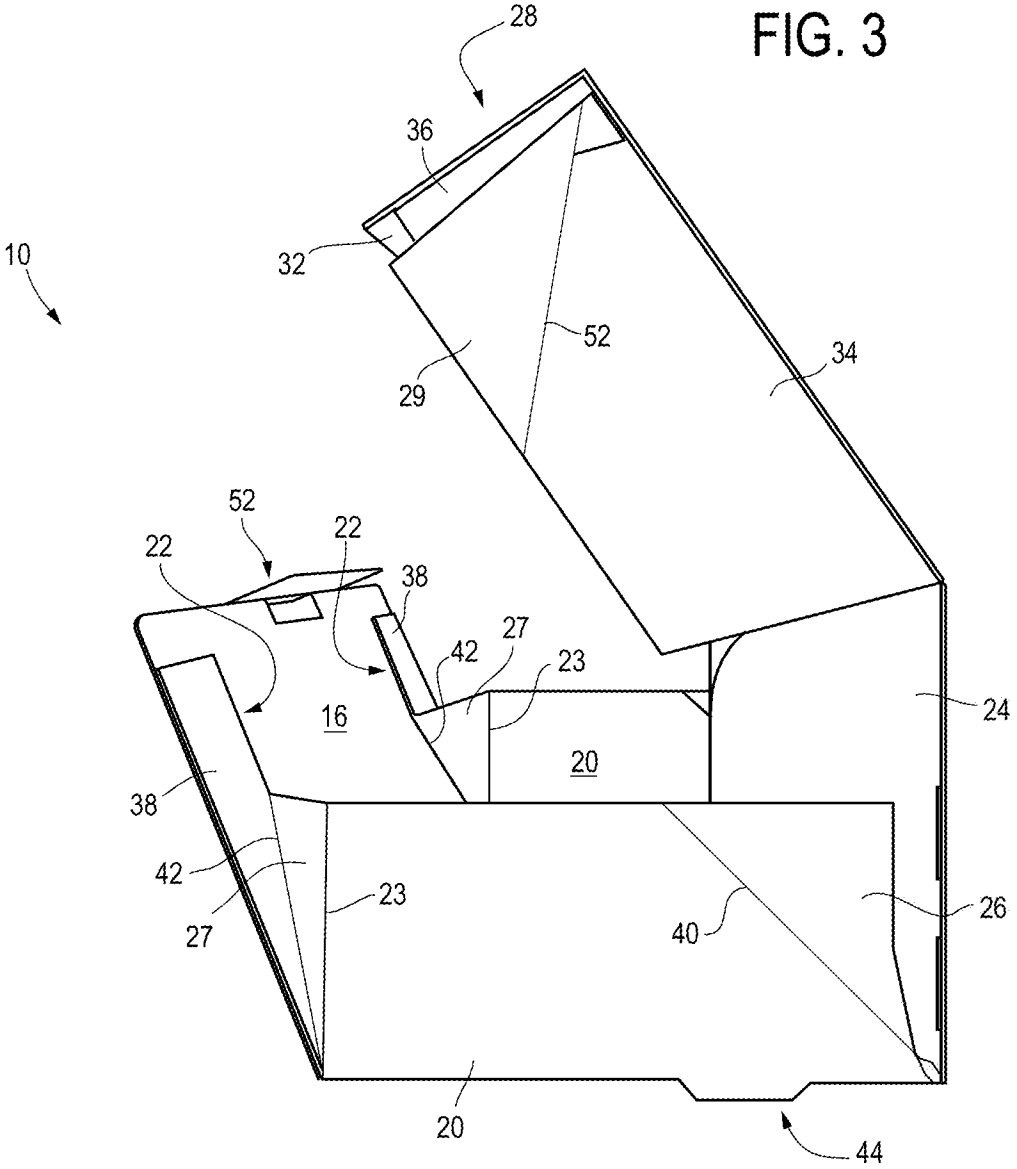
FIG. 3 is a side perspective view of the foldable carton of FIG. 1.
Figure 4:
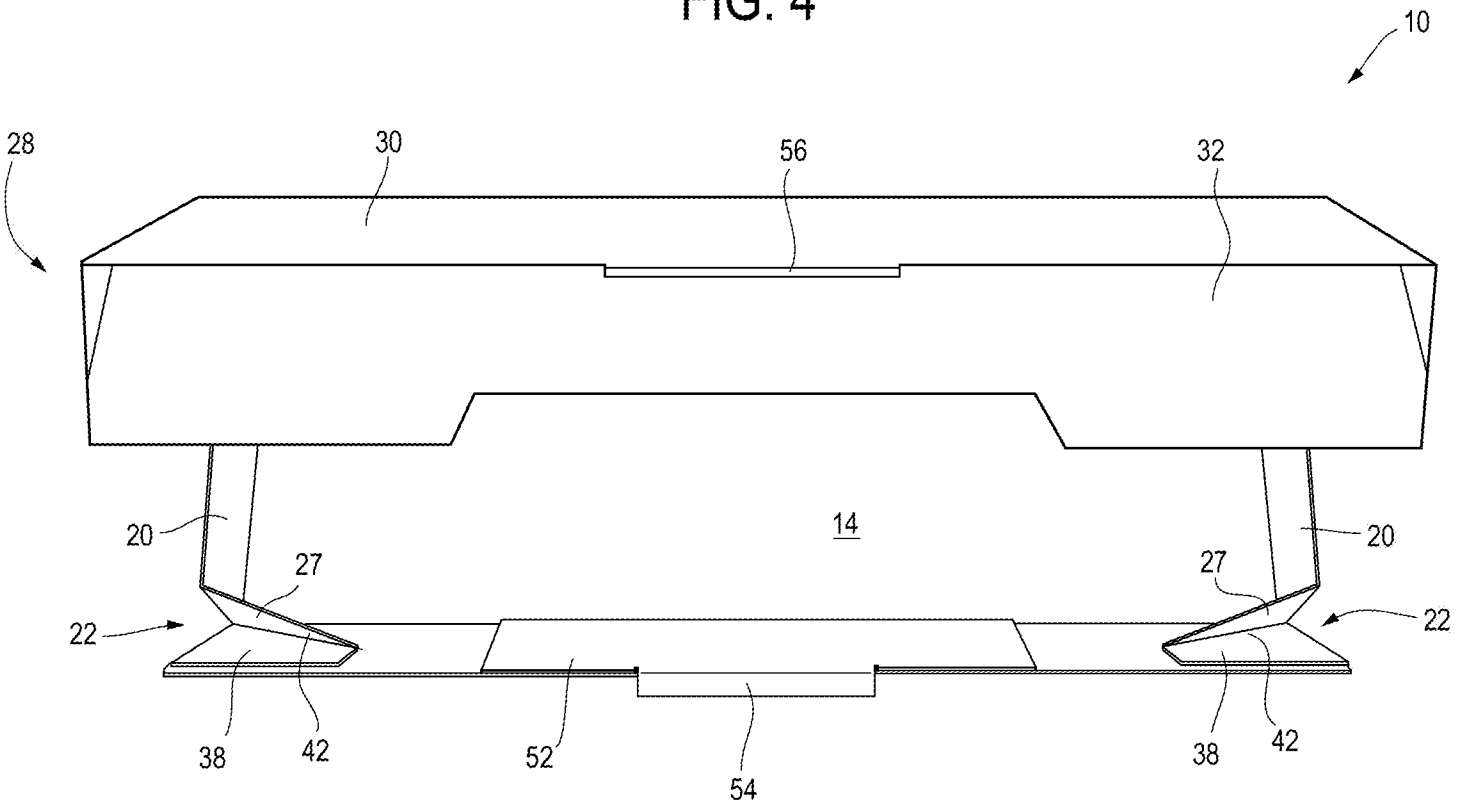
FIG. 4 is a top perspective view of the foldable carton of FIG. 1.

As best shown in the blank 12 illustrated in FIG. 2 along with FIGS. 1, 3 and 4, carton 10 may include a plurality of foldable panels including a bottom panel 14, a front panel 16, a rear panel 18, and end panels 20. Front and rear panels 16 and 18 may each be connected to the front and rear longitudinal edges of bottom panel 14, respectively, by a fold line and extend outwardly therefrom. End panels 20 may by connected to the lateral side edges of bottom panel 14 by a fold line and extend outwardly therefrom. As best shown in FIG. 2, front panel 16 may include front end flap panels 22 connected to each lateral side edge of front panel 16 by a fold line. Front end flap panels 22 may further be connected to end panels 20 by a longitudinal hinged fold line 23 generally aligned with the longitudinal front edge of bottom panel 14 (i.e., the longitudinal edge connecting front panel 16 to bottom panel 14), as best illustrated in FIG. 2. Rear panel 18 can include rear end flap panels 24 connected to each lateral side edge of rear panel 18 by a fold line. According to one embodiment as best shown in FIG. 2, rear end flap panels 24 need not be integral with or connected to end flaps 20 on blank 12.

As shown in FIGS. 1-4, each end panel 20 may include a triangular fold flap 26 formed along the free side end of end panel 20 opposite longitudinal hinged fold line 23 and adjacent to rear end flap panel 24. Triangular fold flap 26 may be formed and defined by an intermediate fold line 40 extending diagonally through the interior of end panel 20 to allow triangular fold flap 26 to fold and rotate with respect to the remainder of end panel 20.

As shown in FIGS. 1-4, each front end flap panel 22 can include a connecting end section 38, which is foldably connected to (and in the formed carton, may be glued, affixed or otherwise attached to) front panel 16, and a triangular fold flap 27 formed into the side of front end flap panel 22 adjacent to end panels 20. As best shown in FIG.

2, triangular fold flaps 27 may be formed and defined by an intermediate fold line 42 extending diagonally through the interior of front end flap panel 22, thereby segmenting or bifurcating front end flap panel 22 into connecting end section 38 and triangular fold flap 27. As further shown in FIGS. 1-4, the triangular fold flap 27 of each front end flap panel 22 may be foldably connected to the adjacent end panel 20 along longitudinal hinged fold line 23. Intermediate fold line 42 can enable the triangular fold flaps 27 of front end flap panels 22 to fold and rotate with respect to the remainder of front end flap panel 22 (i.e., connecting end section 38) and longitudinal hinged fold line 23 can enable triangular fold flaps 27 (and front end flap panels 22 overall) to fold and rotate with respect to end panels 20. In other words, the triangular fold flaps 27 can be foldable relative to respective and adjacent end panels 20, connecting end sections 38, and the front panel 16. Put differently, each end panel 20, connecting end section 38, and the front panel 16 may all be foldable relative to the adjacent triangular fold flap 27. As described in greater detail below, triangular fold flaps 26 and 27 on panels 20 and 22, and connecting end section 38 on panels 22, may facilitate the folding and unfolding of carton 10 between a folded configuration and an unfolded configuration once constructed from blank 12.

As further shown in FIGS. 1-4 according to certain embodiments, carton 10 may include a cover portion 28 foldably connected to rear panel 18. As best shown in FIG. 2, cover portion 28 may include a cover panel 30 foldably connected to rear panel 18 along an upper longitudinal edge of rear panel 18, a cover front panel 32 foldably connected to cover panel 30 along its longitudinal edge opposite rear panel 18, cover end panels 34 foldably connected to each lateral side edge of cover panel 30, and cover side flaps 36 foldably connected to each lateral side edge of cover front panel 32. As also shown in FIG. 2, each cover end panel 34 may include a triangular fold flap 29 formed into the side of panel 34 adjacent to cover front panel 32. The triangular fold flaps 29 of cover portion 28 may be similar to triangular fold flaps 26 of end panels 20 connected to bottom panel 14. Each triangular fold flap 29 can be defined by a intermediate fold line 52 extending diagonally through the interior of cover end panel 34 to allow the triangular fold flap to rotate with respect to the remainder of cover end panel 34.

With continued reference to FIGS. 1-4, the construction of carton 10 from blank 12 according to one embodiment of the present invention will be described in greater detail. As shown in FIGS. 1, 3 and 4, once carton 10 is constructed and formed from blank 12, the triangular fold flap 26 of each end panel 20 may be secured to the exterior side (or, alternatively, interior side) of the corresponding adjacent rear end flap panel 24 by glue, adhesive or other suitable securing means. This configuration connects each end panel 20 to the adjacent rear end flap panel 24 only at the triangular fold flap 26 portion of end panel 20, which is defined by intermediate fold line 40 extending intermediately and diagonally across end panel 20. This configuration can enable end panels 20 to pivot, fold, bow or flex inward with respect to bottom panel 14 along with rear panel 18 (as described in greater detail below) because the non-secured portion of end panels 20 are not obstructed by rear end flap panels 24.

As also shown in FIGS. 1, 3 and 4, each front end flap panel 22 may be secured to front panel 16 by glue, adhesive or other suitable securing means at connecting end section 38 of front end flap panel 22. As best shown in FIG. 2, connecting end section 38 can represent the portion of front end flap panel 22 not including the triangular fold flap 27. As shown, connecting end section 38 may be folded over onto front panel 16 in any overlapped arrangement and secured in the overlying position with respect to the interior surface of front panel 16. This configuration enables front panel 16 to pivot or rotate with respect to end panels 20 about intermediate fold line 42 that defines the interior edge of triangular fold flap 27 within front end flap panel 22 and foldably connects triangular fold flap 27 to the remainder of front end flap panel 22 secured to front panel 16 (i.e., connecting end section 38).

Depending on the particular embodiment of carton 10, connecting end section 38 of front end flap panel 22 may have any suitable configuration that enables triangular fold flap 27 of front end flap panel 22 to be pivotally connected to front panel 16 and end panel 20 (via fold line 42). The embodiment illustrated in the figures shows connecting end portion 38 as a flap portion of front end flap panel 22 that is foldably connected to front panel 16, folded over onto the interior surface of front panel 16 in an overlapped arrangement, and secured to the interior surface of front panel 16 in this overlapping position; however, any other suitable configuration may also be utilized. Non-limiting examples may include connecting triangular fold flap 27 directly to front panel 16 along fold line 42 using a flexible adhesive or other securing means, have connecting end section 38 partially or fully inserted through front panel 16 and secured thereto, or any other suitable configuration where triangular fold flap 27 is enable to rotate and pivot relative to front panel 16 along fold line 42 while remaining pivotally connected to end panel 20 by fold line 23. According to certain embodiments of carton 10, connecting end section 38 need not be foldably connected to front panel 16 and instead front end flap panels 22 can be only connected to end panels 20 along hinged fold line 23 connected triangular fold flap 27 of front end flap panel 22 to end panel 20.

As further shown in FIGS. 1, 3 and 4, the triangular fold flaps 29 of each cover end panel 34 can be connected to cover side flaps 36 in a manner similar to end panels 20 and rear end flap panels 24 described above to allow cover end panels 34 to move inward relative to cover panel 30. Triangular fold flaps 29 may be secured to the exterior of cover side flaps 36 (by adhesive or other means) to allows the remaining portion of cover panel 34 to fold and pivot with respect to cover side flap 36.

As best illustrated by FIGS. 1-4 and described above, carton 10 is formed from blank 12 by folding rear panel 18 upward relative to bottom panel 14 and attaching the triangular fold flap 26 of each end panel 20 to the exterior, outer side of rear end flap panel 24. Front panel 16 is similarly folded upward relative to bottom panel 14 and connecting end section 38 of front end flap panel 22 is folded or placed into an overlapped arrangement with respect to the interior surface of front panel 16 and secured thereto. Cover portion 28 can also be formed by folding cover front panel 32 along the edge of cover panel 30 upward and attaching the triangular fold flap 29 of each cover end panel 34 to the exterior of cover side flaps 36.

As further shown in FIGS. 1, 3 and 4, once carton 10 is constructed from blank 12, front panel 16 is free to partially rotate and extend outward relative to bottom panel 14 (and the remainder of the carton 10, including the end panels 20, rear panel 18, cover portion 28, etc.) due to the connection between front end flap panels 22 and end panels 20. As shown, the triangular fold flap 27 of each front end flap panel 22 is foldably connected to end panel 20 by fold line 23 to restrict the movement of front panel 16 with respect to end panels 20. In addition, the opposing edge of each triangular fold flap 27 (i.e., fold line 42) is foldably connected to the connecting end section 38 of front end flap panel 22 secured to front panel 16. As a result, the triangular fold flaps 27 of front end flap panels 22 are able to pivot at both edges defined by intermediate fold line 42 and hinged fold line 23. This can allow front panel 16 to extend outward and rotate about the longitudinal fold line connecting front panel 16 to bottom panel 14; however, the connection between front end flap panels 22 and end panels 20 (by means of fold line 23) restricts front panel 16 from fully extending (i.e., rotating approximately 180° relative to bottom panel 14) once carton 10 is placed into an unfolded configuration as best shown in FIGS. 3 and 4.

As illustrated in the figures, from its fully vertical position, front panel 16 may be configured to rotate or extend outward (i.e., away from end panels 20 and bottom panel 14) at an angle between about 0° and about 60°. In other words, front panel 16 may be free to rotate approximately between about 90° and about 150° with respect to bottom panel 14, where front panel is at 90° in a fully upright position, and greater than 90° in a partially upright position. However, it is also recognized that any desired angle or rotation may be achieved by adjusting the size and configuration of triangular fold flap 27 and/or the orientation of fold line 42.

Figure 5:
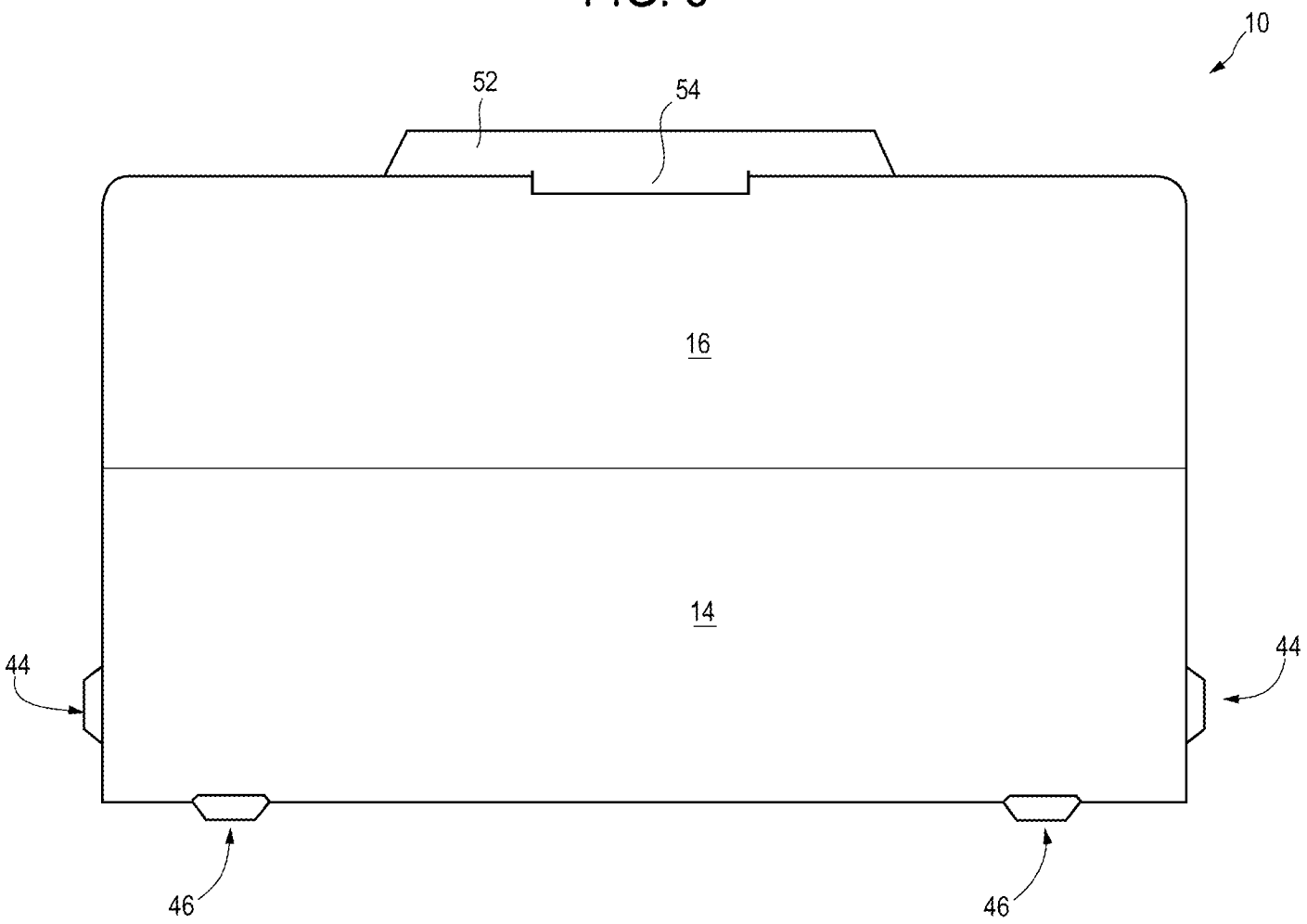
FIG. 5 is a bottom perspective view of a foldable carton placed into a folded configuration in accordance with one embodiment of the present invention.
Figure 6:
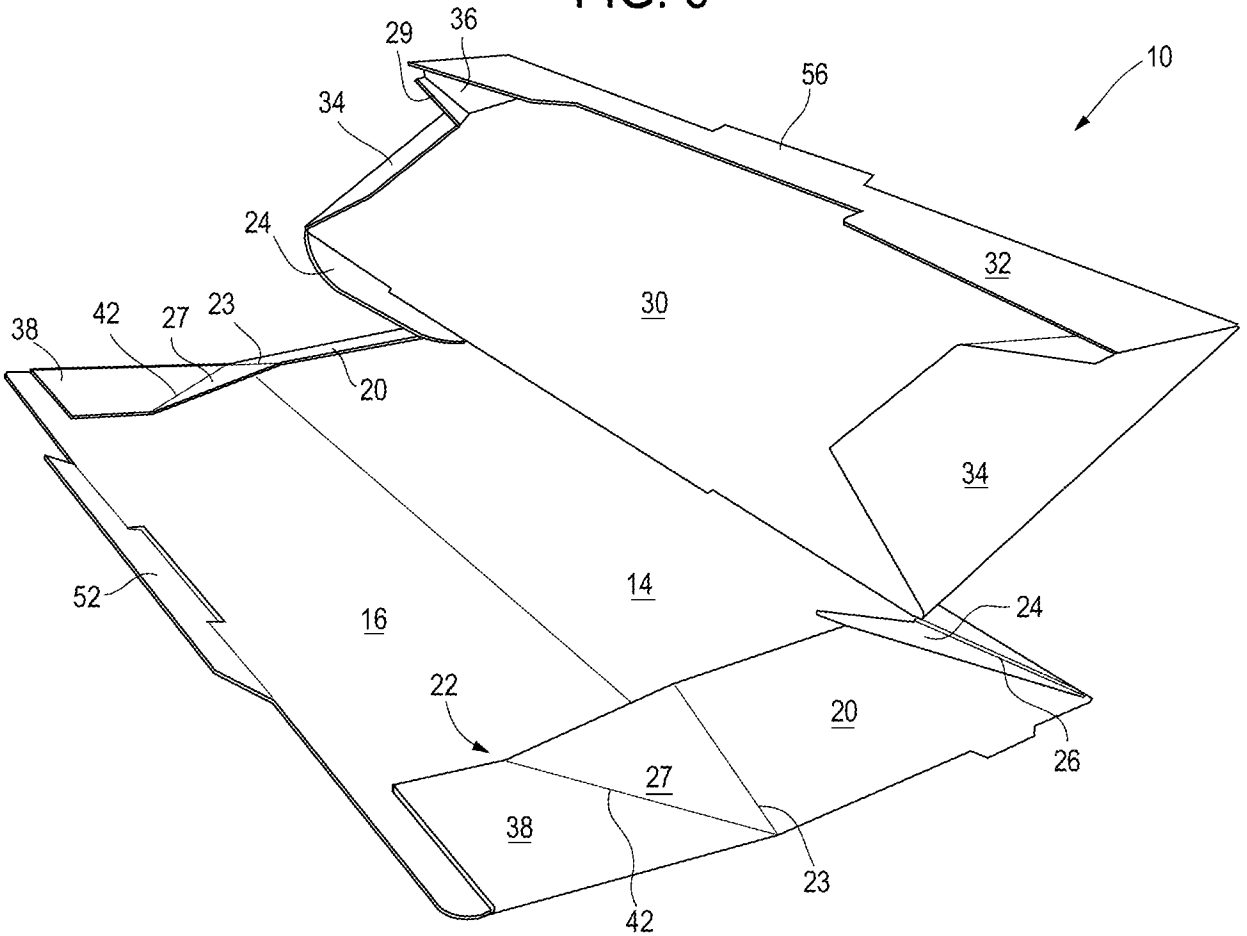
FIG. 6 is a perspective view of the foldable carton of FIG. 5 illustrating the foldable carton in a partially folded configuration with a cover portion in an opened position to illustrate the interior of the foldable carton in accordance with one embodiment of the present invention.

Turning to FIGS. 5 and 6, carton 10 is illustrated in a folded configuration according to one embodiment of the present invention (FIG. 6 illustrates carton 10 in a partially folded configuration to more clearly illustrate the foldable components of carton 10). As shown in FIG. 5, in the folded configuration, front panel 16 is folded outward about the fold line connecting front panel 16 to bottom panel 14 so that front panel 16 and bottom panel 14 are positioned in a generally flattened and parallel arrangement and both front panel 16 and bottom panel 14 extend along a similar plane (or generally the same plane), which is enabled due to the connection between front end flap panels 22 and end panels 20.

As best illustrated by FIG. 6, as front panel 16 is folded outward and parallel to bottom panel 14, end panels 20 may be folded inward to overlie bottom panel 14. Because connecting end section 38 of front end flap panels 22 is secured to the interior surface of front panel 16, front panel 16 may be fully extended outward as end panels 20 are folded inward in the overlapped arrangement with bottom panel 14 due to the dual-hinged arrangement of the triangular fold flaps 27 of front end flap panels 22, which are free to rotate about both ends by intermediate fold line 42 connecting flap 27 to connecting end portion 38 (and thus front panel 16) and hinged fold line 23 connecting flap 27 to end panel 20. In this configuration, the triangular fold flaps 27 of front end flap panels 22 lay generally flat and under against front panel 16 while end panels 20 are folded inward and lay generally flat against bottom panel 14 so that connecting end section 38, triangular fold flap 26, and end panel 20 all are generally aligned along the same plane in an overlapped arrangement with front panel 16 and bottom panel 14. In addition, rear end flap panels 24 are folded inward and lay generally flat against rear panel 18. Rear end flap panels 24 are able to fold inward against rear panel 18 when end panels 20 are folded inward against bottom panel 14 due to the exterior connection of the triangular fold flaps 26 of end panels 20 to rear end flap panels 24, which allows the remaining (un-connected) portion of end panels 20 to rotate freely with respect to rear end flap panels 24.

As further shown in FIGS. 5 and 6, cover portion 28 may also be folded into a flat orientation that overlies (or underlies) bottom panel 14 and front panel 16. Cover portion 28 may be folded into this orientation by folding the front cover panel 32, cover end panels 34 and cover side flaps 36 inward against cover panel 30, and then extending cover panel 30 (and cover portion 28 overall) in a generally parallel position relative to rear panel 18 so that both cover portion 28 and rear panel 18 overlie (or underlie) bottom panel 14 and front panel 16.

As shown in FIGS. 5 and 6, while in the folded configuration, the front panel 16 may be folded outward away from bottom panel 14 and the rear panel 18 may be folded inward and overlap bottom panel 14. This arrangement of front panel 14 (which is allowed by the configuration and connection between front end flap panels 22 and end panels 20) allows for carton 10 to be designed with front and rear sidewall panel heights greater than one-half the depth of the bottom panel. Prior art designs of folding carton designs restricted the height of the sidewalls to one-half the depth of the bottom panel due to the fact that both the front and rear panels were required to be folded inward and overlap the bottom panel when placed into a folded configuration. The design of carton 10 of the present invention is not restricted to sidewall heights less than or equal to one-half the bottom panel depth because the configuration and connection of front end flap panels 22 and end panels 20 allow front panel 16 to be folded outward relative to bottom panel 14 in the folded configuration. This can allow carton 10 of the present invention particularly suitable for applications where it is desired to have an elongated and/or narrow carton design that can be folded into a flattened folded configuration prior to use.

FIGS. 1, 3-4 and 8-9 illustrate carton 10 in the unfolded and erected configuration in accordance with one embodiment of the present invention. As best illustrated by FIGS. 1, 3 and 4, both end panels 20 may be folded upward relative to bottom panel 14 and into a generally perpendicular orientation. When end panels 20 are unfolded, rear end flap panels 24 will also fold outward relative to rear panel 18 and into a generally perpendicular orientation due to the connection between rear end flap panels 24 and the triangular fold flaps 26 of end panels 20. As best shown in FIG. 2 (as well as FIG. 7), bottom panel 14 may include a pair of side and rear slots 44 and 46, respectively, defined into the fold lines connecting bottom panel 14 to end panels 20 and the fold line connecting bottom panel 14 to rear panel 18. These slots 44 and 46 can be configured to receive a corner edge 48 of rear end flap panels 24 in order to lock rear end flap panels 24 in either a folded position (where corner edge 48 is received within rear slots 46) or an upright position (where corner edge 48 is received within front slots 44).

As further shown in FIGS. 1, 3-4 and 8-9, when end panels 20 are folded upward into an upright orientation relative to bottom panel 14, front panel 16 is required to fold upward partially due to the connection of the triangular fold flaps 27 of front end flap panels 22 to end panels 20 along fold line 23. Because the triangular fold flaps 27 are foldably connected to both the connecting end section 38 of front end flap panels 22 (which are secured in an overlapping relationship to front panel 16) and end panels 20 to provide a dual-hinged arrangement, front panel 16 is allowed to rotate between a partially upward folded position (e.g., a partially upright position) to a generally perpendicular folded position (e.g., a fully upright position) relative to bottom panel 14 as described above. This configuration where front panel 16 is free to be partially extended outward can allow for easier access to the interior of carton 10 and any contents contained therein, particularly where carton 10 is configured with a more elongated and narrow design.

As further shown in FIGS. 1, 3 and 4, front panel 16 may have a bias toward its partially upright position, where it is extended partially away from a fully perpendicular and vertical position with respect to bottom panel 14. This may be achieved primarily through the connection of triangular fold flaps 27 to connecting end section 38 of front end flap panels 22 along fold line 42 (and also partially through the connection of end panels 20 and front end flap panels 22 through hinged fold lines 23). When front panel 16 is in a fully upright or perpendicular position relative to bottom panel 14, triangular fold flap 27 of front end flap panel 22 is generally perpendicular to end panel 20 and in an overlapping and parallel position relative to connecting end section 38 (as well as front panel 16). Fold line 42 may be configured to urge against this fully folded configuration and naturally push outward, causing front panel 16 into its partially upright position.

Figure 7:
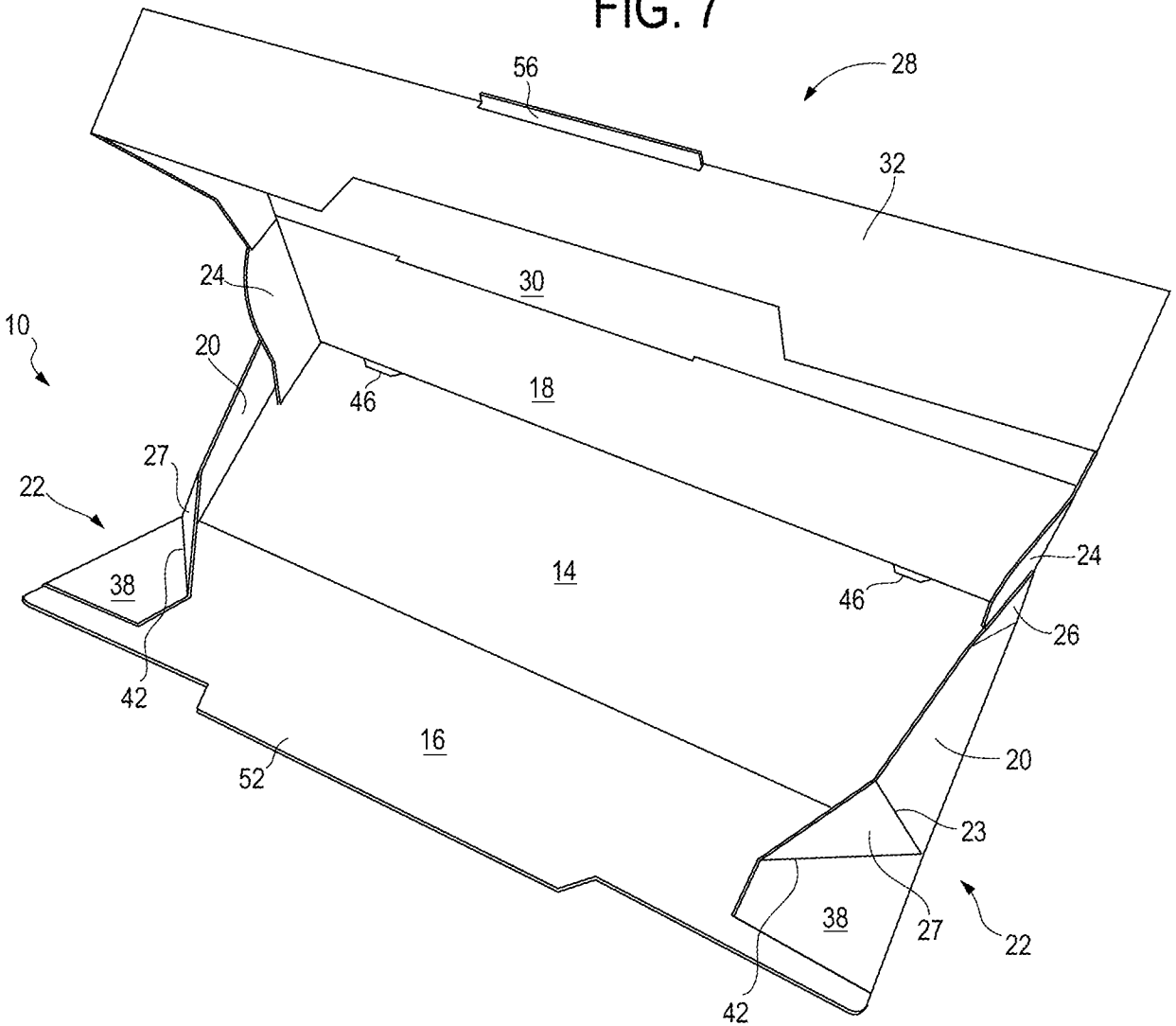
FIG. 7 is a top perspective view of a foldable carton of FIG. 5 illustrating the foldable carton in an unfolded configuration having the front panel extending forward and the cover portion in an opened position accordance with one embodiment of the present invention.

As shown in FIGS. 6 and 7, cover portion 28 may be unfolded in a similar manner to the lower portion of carton 10. As shown, cover end panels 34 may be unfolded into a generally perpendicular position relative to cover panel 30. At the same time, cover front panel 32 may also fold outward into a generally perpendicular position relative to cover panel 30 due to the connection of cover end panels 34 and cover side flaps 36.

Figure 8:
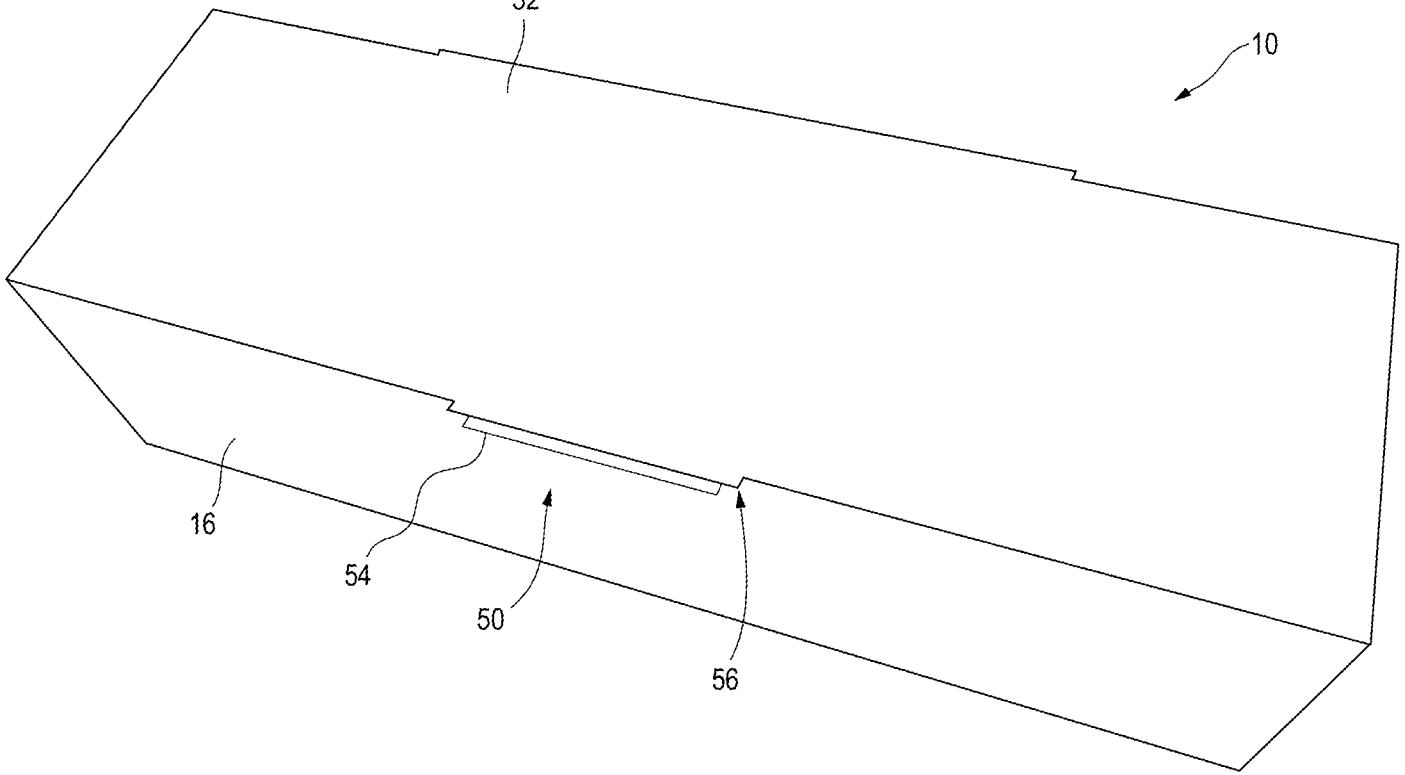
FIG. 8 is a top perspective view of the foldable carton of FIG. 7 illustrating the foldable carton in an unfolded configuration with a cover portion in a closed position in accordance with one embodiment of the present invention.
Figure 9:
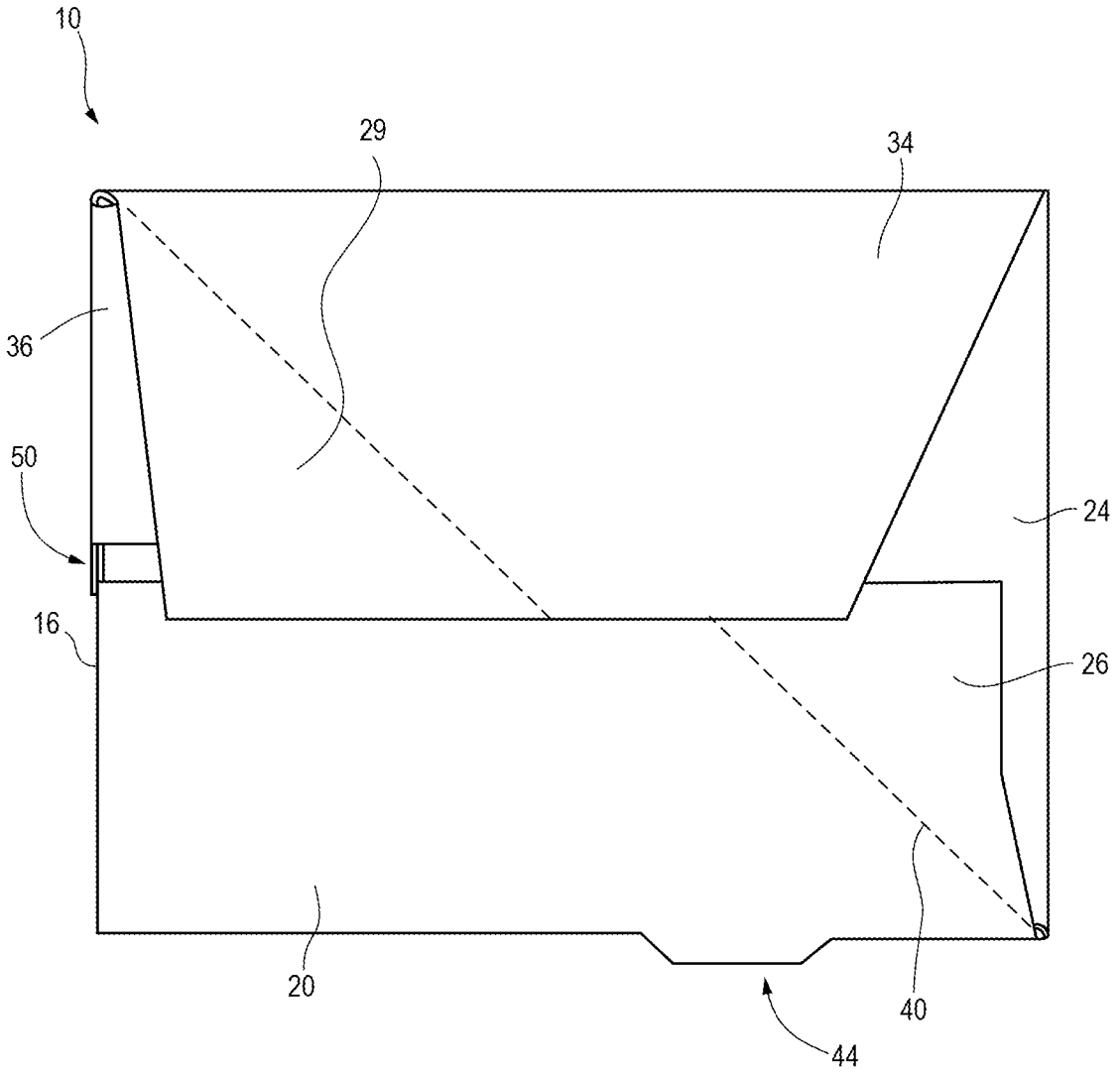
FIG. 9 is a side perspective view of the foldable carton of FIG. 8.

FIGS. 8 and 9 illustrate carton 10 in its unfolded configuration where cover portion 28 is secured into a closed position. As shown in FIGS. 8 and 9, when cover portion is in the closed position, cover front panel 32 is positioned over front panel 16 and holds front panel 18 in a generally perpendicular position relative to bottom panel 14.

As best shown in FIGS. 2, 4 and 8, carton 10 can include a locking mechanism 50 that can be used to secure cover portion 28 in its closed position. Locking mechanism 50 can include a locking flap 52 foldably connected to the upper free edge of front panel 16 and include a locking tab 54 that extends outward away from front panel 16. Locking mechanism 50 can also include a slot 56 defined into the fold line connecting cover panel 30 and cover front panel 32. As best shown in FIGS. 8 and 9, when cover portion 28 is placed into the closed position, front panel 16 is forced into a perpendicular position and cover front panel 32 overlies the exterior of front panel 16. Locking tab 54 may then be inserted through slot 56 in cover portion 28 to secure and lock cover panel 28 in the closed position. Because front panel 16 has a bias toward a partially upright position rather than a fully upright (and generally perpendicular) position, an interference and interlocking fit is formed between locking tab 54 and slot 56 which assists locking mechanism 50 in maintaining cover portion 28 in a closed and locked position. It will also be appreciated that locking mechanism 50 of carton 10 may be designed in any suitable manner in alternative embodiments of the present invention.

As shown throughout the several figures, carton 10 provides a folding tray/carton design that allows for a variety of different dimensional configurations of bottom panel 14 and sidewall panels 16-20, including dimensional configurations where the height of front and rear panels 16 and 18 may be greater than one-half the depth of bottom panel 14, due to the configuration and connection of front panel 16 to end panels 20 that enables front panel 16 to fold outward (rather than inward) with respect to bottom panel 14 when in a folded configuration. Further, the connection between front panel 16 and end panels 20 through triangular fold flaps 27 and hinged fold line 23 enable front panel 16 to be biased toward a partially upright position relative to bottom panel 18 when in the unfolded configuration. This enables easier access to the interior of carton 10 and facilitates a more secure locking mechanism 50 that secures cover portion 28 in a closed position.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A foldable carton comprising:

a bottom panel;

a front panel foldably connected to the bottom panel along a longitudinal front edge of the bottom panel;

a rear panel foldably connected to the bottom panel along a longitudinal rear edge of the bottom panel;

a first end panel foldably connected to the bottom panel along a lateral edge of the bottom panel;

a front end flap panel foldably connected to the front panel along a lateral edge of the front panel, the front end flap panel comprising a connecting end section and a triangular fold flap formed by an intermediate fold line extending diagonally through the front end flap panel; and a rear end flap panel foldably connected to the rear panel along a lateral edge of the rear panel;

wherein the triangular fold flap of the front end flap panel is connected to a side edge of the first end panel by a hinged fold line;

wherein the connecting end section of the front end flap panel is secured to the front panel in an overlapped arrangement;

wherein the triangular fold flap of the front end flap panel is configured to rotate about the intermediate fold line to permit the front panel to move between a fully upright position and a partially upright position.

2. The carton of claim 1, wherein the carton is configured to transition between a folded configuration and an unfolded configuration, wherein the front panel and the bottom panel are positioned in a generally flattened and generally parallel arrangement when the carton is in the folded configuration.

3. The carton of claim 2, wherein when the carton is in the folded configuration, the front panel is folded outward relative to the bottom panel and the rear panel is folded inward relative to the bottom panel so that the rear panel is generally parallel to and overlies the bottom panel and the front panel is adjacent to the bottom panel.

4. The carton of claim 3, wherein when the carton is in the unfolded configuration, the first end panel is extends upward into a generally perpendicular position relative to the bottom panel and the front and rear panels extend in an upright position.

5. The carton of claim 2, wherein the front panel has a height greater than one-half a depth of the bottom panel.

6. The carton of claim 5, wherein the rear panel has a height greater than one-half the depth of the bottom panel.

7. The carton of claim 1, wherein the first end panel includes a triangular fold flap formed by an intermediate fold line extending adjacent to a longitudinal edge of the first end panel opposite the side edge and the hinged fold line, wherein the triangular fold flap is secured to the rear end flap panel in an overlapped arrangement.

8. The carton of claim 1, wherein the front panel is configured to rotate about the longitudinal front edge of the bottom panel between a fully upright position and a partially upright position.

9. The carton of claim 8, wherein the front panel is biased toward the partially upright position.

10. The carton of claim 1, wherein the triangular fold flap of the front end flap panel is configured to rotate about the hinged fold line to permit the front end panel to move between a fully upright position and a partially upright position.

11. The carton of claim 1, further comprising a cover portion foldably attached to an upper edge of the rear panel.

12. The carton of claim 11, wherein the cover portion comprises:

a cover panel foldably connected to the rear panel along the upper edge of the rear panel; and a front cover panel foldably connected to the cover panel along a longitudinal edge of the cover panel opposite the upper edge of the rear panel.

13. The carton of claim 12 further comprising a locking mechanism configured to secure the cover portion in a closed position, wherein the locking mechanism comprises a locking tab defined into an upper edge of the front panel, the locking tab extending outward away from the bottom panel, and a slot defined into the front cover panel.

14. The carton of claim 13, wherein the locking tab frictionally engages the slot when the cover portion is in the closed position.

15. A foldable carton comprising:

a bottom panel;

a front panel connected to a first longitudinal edge of the bottom panel;

a rear panel connected to a second longitudinal edge of the bottom panel opposite the first longitudinal edge;

a first end panel connected to a first lateral edge of the bottom panel;

a front end flap panel attached to the front panel on an interior surface of the front panel, the front end flap panel comprising a triangular fold flap; and a rear end flap panel connected to the rear panel along a lateral edge of the rear panel;

wherein the triangular fold flap of the front end flap panel is connected to a side edge of the first end panel by a hinged fold line;

wherein the triangular fold flap of the front end flap panel is configured to rotate with respect to the front panel and with respect to the first end panel;

wherein the triangular fold flap of the front end flap panel is configured to rotate about an intermediate fold line formed in the front end flap panel to permit the front panel to move between a fully upright position and a partially upright position relative to the bottom panel.

16. A foldable carton comprising:

a bottom panel;

a front panel foldably connected to the bottom panel along a longitudinal front edge of the bottom panel;

a rear panel foldably connected to the bottom panel along a longitudinal rear edge of the bottom panel;

a first end panel foldably connected to the bottom panel along a lateral edge of the bottom panel;

a front end flap panel foldably connected to the front panel along a lateral edge of the front panel, the front end flap panel comprising a connecting end section and a triangular fold flap formed by an intermediate fold line extending diagonally through the front end flap panel; and a rear end flap panel foldably connected to the rear panel along a lateral edge of the rear panel;

wherein the triangular fold flap of the front end flap panel is connected to a side edge of the first end panel by a hinged fold line;

wherein the connecting end section of the front end flap panel is secured to the front panel in an overlapped arrangement;

wherein the carton is configured to transition between a folded configuration and an unfolded configuration, wherein the front panel and the bottom panel are positioned in a generally flattened and generally parallel arrangement when the carton is in the folded configuration.

17. The carton of claim 16, wherein when the carton is in the folded configuration, the front panel is folded outward relative to the bottom panel and the rear panel is folded inward relative to the bottom panel so that the rear panel is generally parallel to and overlies the bottom panel and the front panel is adjacent to the bottom panel.

18. The carton of claim 17, wherein when the carton is in the unfolded configuration, the first end panel is extends upward into a generally perpendicular position relative to the bottom panel and the front and rear panels extend in an upright position.

19. The carton of claim 16, wherein the front panel has a height greater than one-half a depth of the bottom panel.

20. The carton of claim 19, wherein the rear panel has a height greater than one-half the depth of the bottom panel.

* * * * *